US011512422B2

(12) United States Patent
Kim et al.

(10) Patent No.: US 11,512,422 B2
(45) Date of Patent: Nov. 29, 2022

(54) CLOTHES TREATMENT APPARATUS

(71) Applicant: LG Electronics Inc., Seoul (KR)

(72) Inventors: Kihyuk Kim, Seoul (KR); Jaeil Bae, Seoul (KR); Wookjun Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 19 days.

(21) Appl. No.: 17/316,283

(22) Filed: May 10, 2021

(65) Prior Publication Data

US 2021/0262157 A1 Aug. 26, 2021

Related U.S. Application Data

(63) Continuation of application No. 16/242,494, filed on Jan. 8, 2019, now Pat. No. 11,001,960.

(30) Foreign Application Priority Data

Jan. 8, 2018 (KR) ..... 10-2018-0002471

(51) Int. Cl.

| | |
|---|---|
| ***D06F 73/02*** | (2006.01) |
| ***D06F 58/10*** | (2006.01) |
| *D06F 71/29* | (2006.01) |

(52) U.S. Cl.

CPC ..... *D06F 73/02* (2013.01); *D06F 58/10* (2013.01); *D06F 71/29* (2013.01)

(58) Field of Classification Search

CPC ..... D06F 73/02

See application file for complete search history.

(56) References Cited

FOREIGN PATENT DOCUMENTS

| | | |
|---|---|---|
| CN | 104294529 | 1/2015 |
| CN | 104695195 | 6/2015 |
| CN | 105714543 | 6/2016 |
| EP | 0816552 | 1/1998 |
| EP | 2826911 | 1/2015 |
| EP | 2889426 | 7/2015 |
| EP | 3034684 | 6/2016 |
| JP | 3904293 | 4/2007 |
| KR | 100444005 | 11/2004 |

(Continued)

OTHER PUBLICATIONS

CN Office Action in Chinese Appln. No. 201910016185.8, dated May 24, 2021, 13 pages (with English translation).

(Continued)

*Primary Examiner* — Jason Y Ko

(74) *Attorney, Agent, or Firm* — Fish & Richardson P.C.

(57) ABSTRACT

A clothes treatment apparatus is disclosed. The clothes treatment apparatus includes a case defining the external appearance and having an open front, a first clothes treatment chamber defining a space in the case to treat clothes using steam or air circulation, a second clothes treatment chamber defining a space at one side of the first clothes treatment chamber in the case to remove wrinkles from clothes by applying pressure to the clothes, a machine chamber provided in the case to spray steam to or circulate air through the first clothes treatment chamber or the second clothes treatment chamber, and a partition plate configured to be movable to a position for closing the second clothes treatment chamber so that the second clothes treatment chamber is separated from the first clothes treatment chamber and to the open front of the case to open the second clothes treatment chamber.

20 Claims, 13 Drawing Sheets

(56) References Cited

FOREIGN PATENT DOCUMENTS

| | | |
|---|---|---|
| KR | 1020080001854 | 1/2008 |
| KR | 1020110048343 | 5/2011 |
| KR | 1020110048344 | 5/2011 |
| KR | 1020150009718 | 1/2015 |
| KR | 1020160075033 | 6/2016 |

OTHER PUBLICATIONS

EP Extended European Search Report in European Appln. No. 19150711.0, dated May 23, 2019, 8 pages.
EP Extended European Search Report in European Appln. No. 20208330.9, dated Jan. 27, 2021, 8 pages.

CLOTHES TREATMENT APPARATUS

CROSS-REFERENCE TO RELATED APPLICATIONS

This application is a continuation of U.S. application Ser. No. 16/242,494, filed on Jan. 8, 2019, which claims the benefit of an earlier filing date and right of priority to Korean Patent Application No. 10-2018-0002471, filed on Jan. 8, 2018. The disclosures of the prior applications are incorporated by reference in their entirety.

TECHNICAL FIELD

The present disclosure relates to a clothes treatment apparatus, and more particularly to a clothes treatment apparatus including two clothes treatment chambers formed in a case.

BACKGROUND

Clothes treatment apparatuses are apparatuses that treat clothes, e.g. wash and dry clothes and remove wrinkles from clothes, at home or in laundromats.

Clothes treatment apparatuses may be classified into a washer for washing clothes, a dryer for drying clothes, a washer/dryer having both a washing function and a drying function, a refresher for refreshing clothes, and a steamer for removing wrinkles from clothes.

The refresher is an apparatus that keeps clothes comfortable and fresh. The refresher functions to dry clothes, to supply fragrance to clothes, to prevent the occurrence of static electricity in clothes, or to remove wrinkles from clothes.

Korean Patent Laid-open Publication No. 10-2014-0184457 discloses a clothes treatment apparatus including a steamer and a refresher. The disclosed clothes treatment apparatus includes a treatment chamber for treating clothes through air circulation or steam and a wrinkle removal module provided in the treatment chamber to remove wrinkles from clothes by applying pressure to the clothes. However, because the wrinkle removal module is located on the inside of the door, clothes from which wrinkles are to be removed and clothes which are to be treated by steam or air circulation are treated in a single space.

SUMMARY

Therefore, the present invention has been made in view of the above problems, and it is an object of the present invention to provide a clothes treatment apparatus in which the internal space in a case is partitioned into two chambers, in one of which wrinkle removal from clothes is independently performed.

It is another object of the present invention to provide a clothes treatment apparatus in which the internal space in a case is divided into two chambers by a partition plate and damage to clothes is minimized even when the position of the partition plate is changed.

It is a further object of the present invention to provide a clothes treatment apparatus in which the internal space of a case is partitioned into two chambers, including a clothes-pressing chamber, and in which clothes are easily hung in the clothes-pressing chamber.

However, objects to be accomplished by the invention are not limited to the above-mentioned objects, and other objects not mentioned will be clearly understood by those skilled in the art from the following description.

In accordance with the present invention, the above and other objects can be accomplished by the provision of a clothes treatment apparatus including a case defining the external appearance and having an open front, a first clothes treatment chamber defining a space in the case to treat clothes using steam or air circulation, a second clothes treatment chamber defining a space at one side of the first clothes treatment chamber in the case to remove wrinkles from clothes by applying pressure to the clothes, a machine chamber provided in the case to spray steam to or circulate air through the first clothes treatment chamber or the second clothes treatment chamber, and a partition plate configured to be movable to a position for closing the second clothes treatment chamber so that the second clothes treatment chamber is separated from the first clothes treatment chamber and to the open front of the case to open the second clothes treatment chamber. Therefore, the first clothes treatment chamber and the second clothes treatment chamber are separated from each other, and clothes are easily hung in the second clothes treatment chamber by moving the partition plate to the front of the case.

When the partition plate closes the second clothes treatment chamber so that the second clothes treatment chamber is separated from the first clothes treatment chamber, the partition plate may press clothes located in the second clothes treatment chamber. That is, the partition plate may press clothes located in the second clothes treatment chamber while separating the second clothes treatment chamber from the first clothes treatment chamber.

The second clothes treatment chamber may be provided at an inner surface thereof with a base plate configured to support clothes located in the second clothes treatment chamber, and the partition plate may be provided at an inner surface thereof with a press plate configured to be brought into close contact with the base plate to press clothes located therebetween, thereby removing wrinkles from the clothes located in the second clothes treatment chamber.

The clothes treatment apparatus may further include a moving member provided at each of an upper portion and a lower portion of the partition plate so as to protrude therefrom to rotate or linearly move the partition plate.

The second clothes treatment chamber may be provided with a moving member guide portion configured to guide rotation or linear movement of the moving member. Therefore, the partition plate may rotate at one side of the second clothes treatment chamber and may move linearly.

The moving member guide portion may include a first rotation guide configured to guide the partition plate to rotate inside the case, a second rotation guide configured to guide the partition plate to rotate at the open front of the case, and a linear movement guide configured to linearly connect the first rotation guide and the second rotation guide. Therefore, the partition plate may move to the front of the case and may rotate.

When the moving member of the partition plate moves along the linear movement guide, the partition plate may maintain a constant inclination angle with the inner surface of the second clothes treatment chamber. Therefore, even when the partition plate moves, damage to clothes hung on the partition plate may be minimized.

The first rotation guide may be provided with a first stopper for limiting the rotational range of the moving member so that the moving member moves along the linear movement guide. Therefore, the partition plate may be opened and closed while securing the space in the first clothes treatment chamber to a certain extent.

The second rotation guide may be provided with a second stopper for limiting rotation of the moving member in one direction so that the partition plate is located perpendicular to the inner surface of the second clothes treatment chamber. Therefore, since the inner surface of the partition plate is oriented forwards, clothes may be easily hung on the inner surface of the partition plate.

The second rotation guide may be provided with a third stopper for limiting rotation of the moving member in the opposite direction so that the moving member moves along the linear movement guide. Therefore, the partition plate may be moved while minimizing damage to clothes hung on the partition plate.

The moving member may include a protruding portion protruding upwards or downwards from the partition plate so as to be movable or rotatable along the moving member guide portion, and a connection portion protruding from the inner surface of the partition plate to connect the partition plate and the protruding portion. Therefore, the partition plate may move or rotate along the moving member guide portion.

The protruding portion may be configured to be rotatable or movable linearly along the moving member guide portion at a predetermined position. Therefore, the partition plate may move or rotate along the moving member guide portion.

The partition plate may have therein communication holes to cause the first clothes treatment chamber and the second clothes treatment chamber to communicate with each other. Therefore, air or steam flowing in the first clothes treatment chamber may move to the second clothes treatment chamber.

Specific details of other embodiments are included in the following detailed description and accompanying drawings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
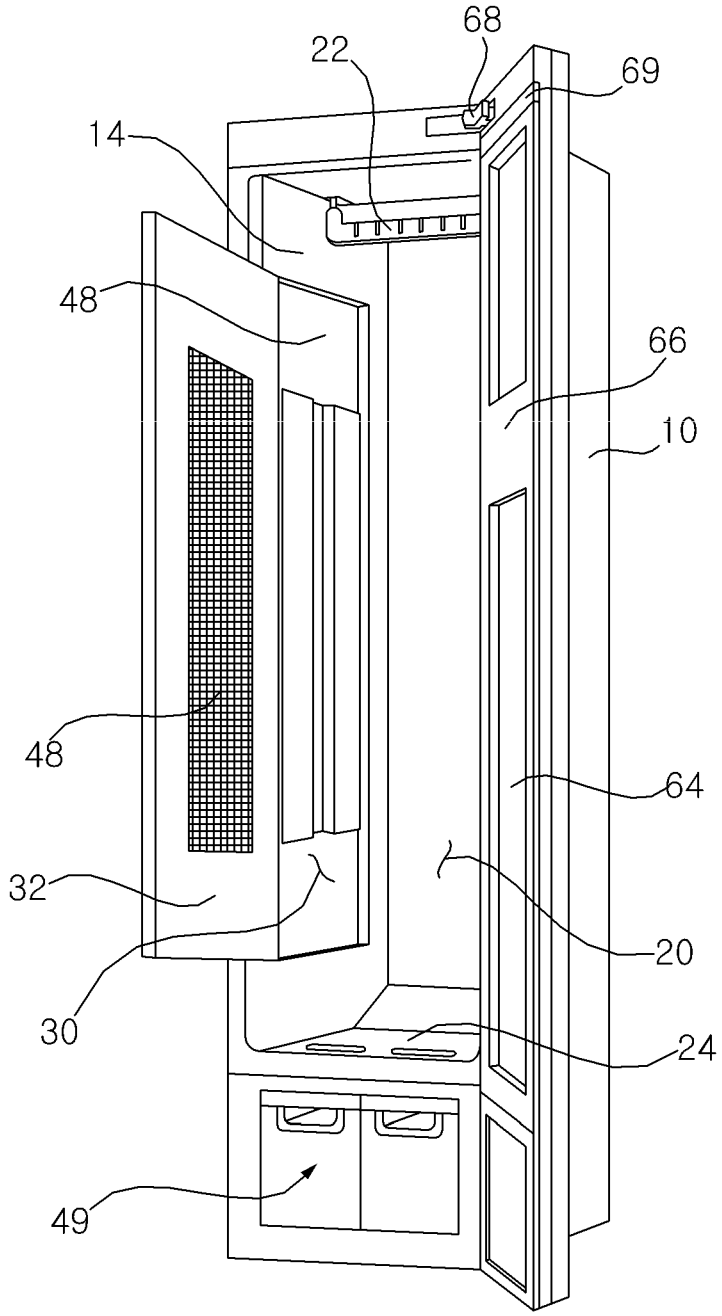
FIG. 1 is a view illustrating a clothes treatment apparatus according to an embodiment of the present invention when a door thereof is opened.

Advantages and features of the present invention and methods for achieving them will be made clear from embodiments described below in detail with reference to the accompanying drawings. The present invention may, however, be embodied in many different forms, and should not be construed as being limited to the embodiments set forth herein. Rather, these embodiments are provided so that this disclosure will be thorough and complete and will fully convey the scope of the invention to those skilled in the art. The present invention is defined only by the scope of the claims. Throughout the specification, the same reference numerals represent the same components.

Hereinafter, a clothes treatment apparatus according to embodiments of the present invention will be described with reference to the accompanying drawings.

<Overall Configuration of Clothes Treatment Apparatus>

Figure 2:
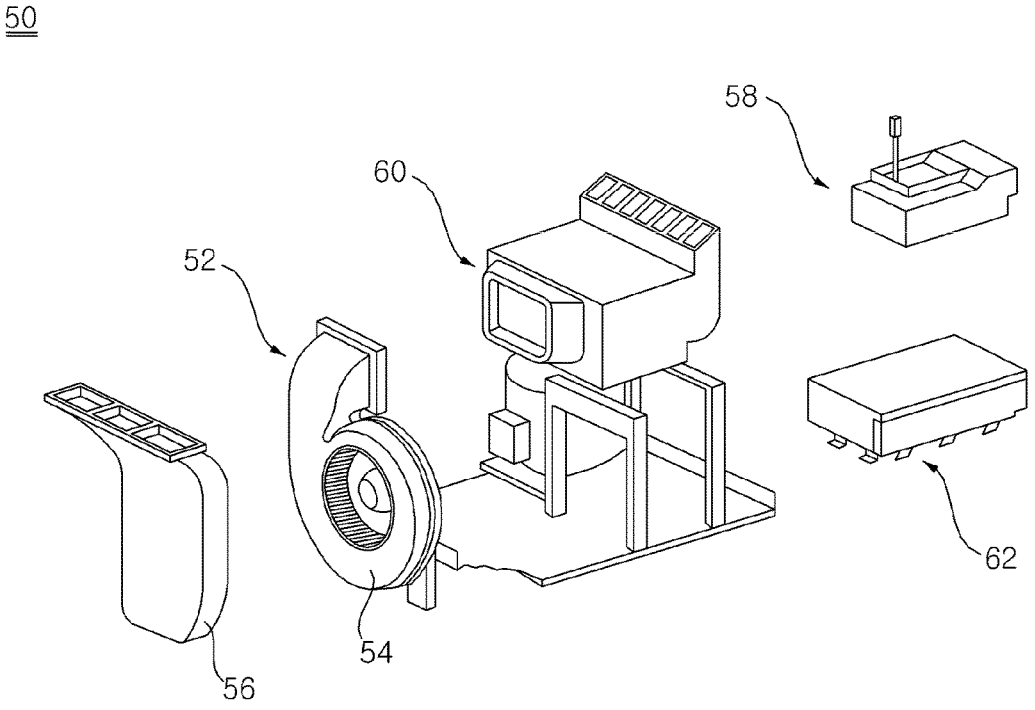
FIG. 2 is an exploded perspective view of a cycle chamber according to an embodiment of the present invention.
Figure 3:
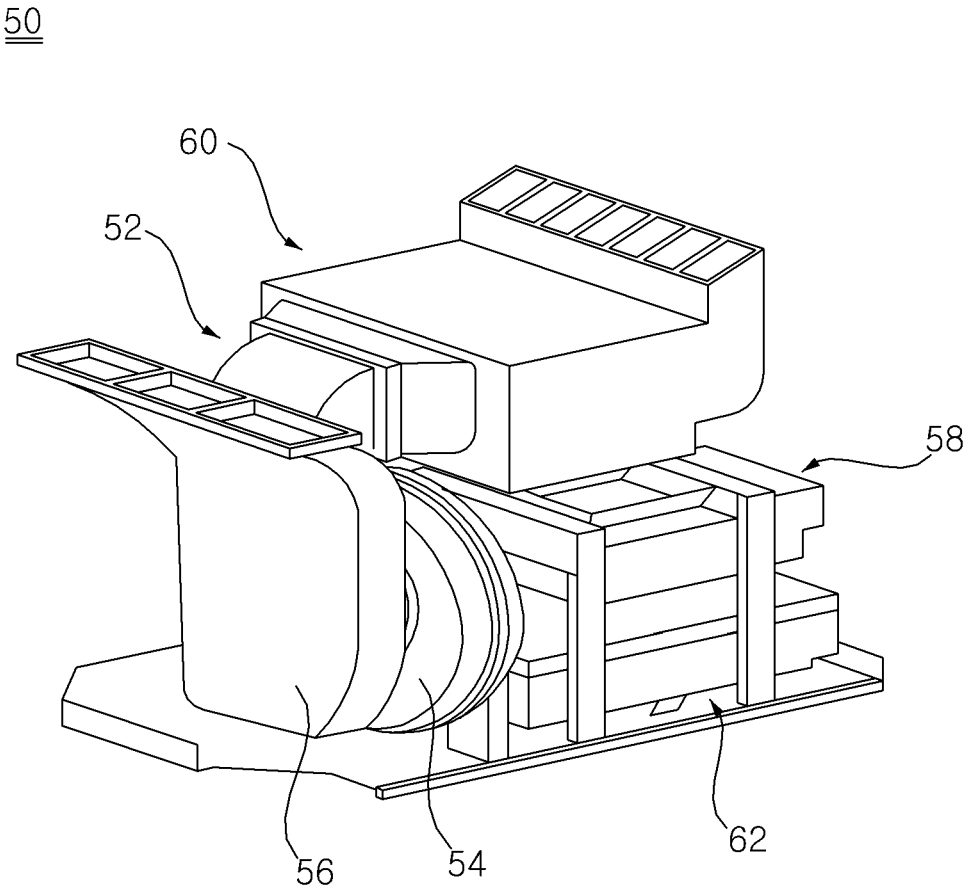
FIG. 3 is a view illustrating the assembled state of the cycle chamber of FIG. 2.

FIG. 1 is a view illustrating a clothes treatment apparatus according to an embodiment of the present invention when a door thereof is opened. FIG. 2 is an exploded perspective view of a cycle chamber according to an embodiment of the present invention. FIG. 3 is a view illustrating the assembled state of the cycle chamber of FIG. 2.

Hereinafter, the configuration of a clothes treatment apparatus according to an embodiment will be described with reference to FIGS. 1 to 3.

The clothes treatment apparatus according to the embodiment includes a case 10, which has a hollow interior and is open at the front thereof, and a door 64 configured to open and close the open front of the case 10.

The case 10 according to the embodiment includes a first clothes treatment chamber 20, in which clothes are hung and treated through steam or air circulation, a second clothes treatment chamber 30, in which wrinkles are removed from clothes by applying pressure to the clothes, and a machine chamber 49, in which a device for spraying steam to or circulating air through the first clothes treatment chamber or the second clothes treatment chamber is installed.

The machine chamber 49 according to the embodiment may include a cycle chamber 50 configured to supply air or steam to the first clothes treatment chamber 20 or the second clothes treatment chamber 30, and a tank module (not shown) configured to supply water to the cycle chamber 50 or to store condensed water generated in the cycle chamber 50.

A blowing unit 52 for circulating air in the first clothes treatment chamber 20 or the second clothes treatment chamber 30, a steam unit 58 for supplying steam to the first clothes treatment chamber 20 or the second clothes treatment chamber 30, a heat pump unit 60 for conditioning air in the first clothes treatment chamber 20 or the second clothes treatment chamber 30, and a control unit 62 for controlling the blowing unit 52, the steam unit 58 and the heat pump unit 60 are installed in the cycle chamber 50.

An assembly of machinery, including the blowing unit 52, the steam unit 58, the heat pump unit 60, and the control unit 62, which are required to perform respective cycles of the clothes treatment apparatus, is defined as a cycle assembly.

The blowing unit 52 includes a blowing fan 54, which is rotated to blow air, specifically, to suction air from the first clothes treatment chamber 20 or the second clothes treatment chamber 30 and to discharge the suctioned air to the heat pump unit 60, and an inlet duct 56 installed at the suction side of the blowing fan 54 to guide the air in the first clothes treatment chamber 20 or the second clothes treatment chamber 30 to the blowing fan 54.

When the steam unit 58 is powered on, heat is generated from the steam unit 58. The steam unit 58 converts water supplied from a water supply tank (not shown) into steam. The generated steam is discharged into the first clothes treatment chamber 20 or the second clothes treatment chamber 30. In the embodiment, a flow channel is defined such that the steam flows into the first clothes treatment chamber 20 or the second clothes treatment chamber 30 via the heat pump unit 60.

The heat pump unit 60 is constituted by a refrigeration cycle, which includes a compressor, a condenser, an evaporator and an expansion valve. Depending on the operation mode of the heat pump unit 60, cooled air or heated air may be discharged into the first clothes treatment chamber 20 or the second clothes treatment chamber 30.

The heat pump unit 60 may dehumidify air supplied from the blowing unit 52 through heat exchange therewith.

A tank module (not shown) for storing water may be installed in front of the cycle chamber 50. In the embodiment, a tank module frame (not shown), by which the tank module is installed in front of the inlet duct 56, may be installed in the machine chamber 49.

The tank module may include a water supply tank (not shown) for supplying water to the steam unit 58 and a drainage tank (not shown) for gathering and storing condensed water that is generated in the first clothes treatment chamber 20 or the second clothes treatment chamber 30. The water supply tank may be connected to the steam unit 58, and may supply water to the steam unit 58.

The drainage tank may be connected to the heat pump unit 60 and may store condensed water that is generated in the heat pump unit 60. In addition, water having moved along the inner surface of the first clothes treatment chamber 20 or the second clothes treatment chamber 30 may also be guided and stored in the drainage tank.

The door 64 may include a door panel 66 for opening and closing the front of the case 10, a hinge unit 68 for connecting the door panel 66 and the case 10 in a hinged fashion, a door gasket 69 disposed at the door panel 66 such that the door gasket 69 is in close contact with the edge of the case 10 to achieve a seal between the door 64 and the case 10, and a door liner disposed at the inside of the door panel 66 to guide condensed water that is generated in the first clothes treatment chamber 20 or the second clothes treatment chamber 30 to a division plate 24.

The door gasket 69 is mounted to the door panel 66 so as to surround the door panel 66. The seal between the door 64 and the case 10 is achieved by the door gasket 69.

<Inner Structure of Case>

Figure 4:
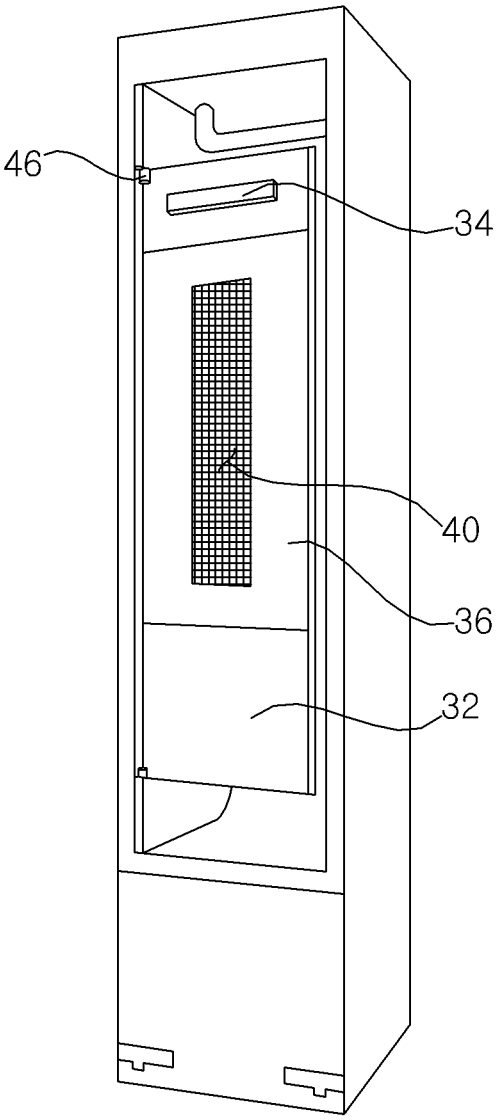
FIG. 4 is a view illustrating the interior of a partition plate according to an embodiment of the present invention.
Figure 5:
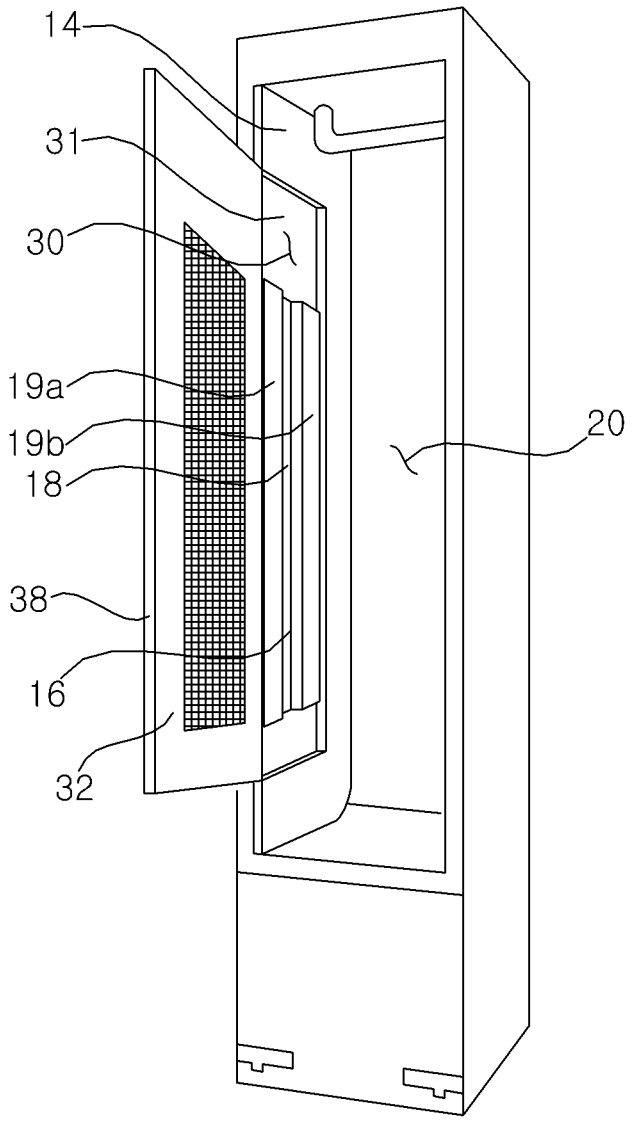
FIG. 5 is a view illustrating a first clothes treatment chamber and a second clothes treatment chamber according to an embodiment of the present invention.
Figure 6:
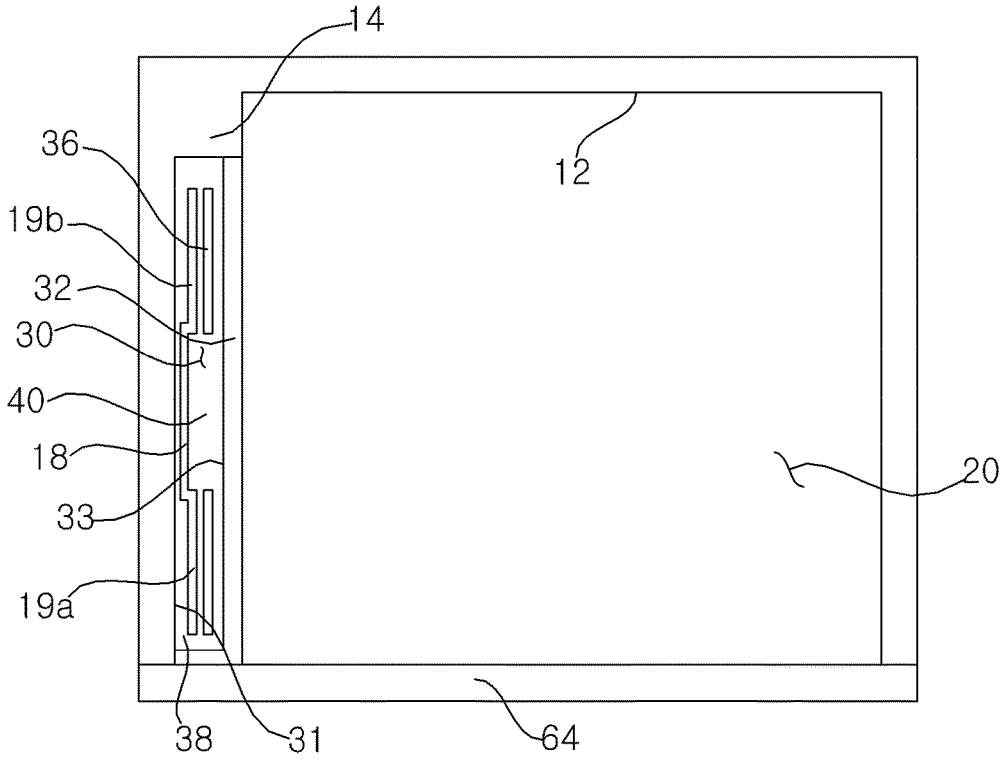
FIG. 6 is a view illustrating the arrangement of the first clothes treatment chamber and the second clothes treatment chamber in the clothes treatment apparatus according to an embodiment of the present invention.

FIG. 4 is a view illustrating the interior of a partition plate according to an embodiment of the present invention. FIG. 5 is a view illustrating a first clothes treatment chamber and a second clothes treatment chamber according to an embodiment of the present invention. FIG. 6 is a view illustrating the arrangement of the first clothes treatment chamber and the second clothes treatment chamber in the clothes treatment apparatus according to an embodiment of the present invention.

Hereinafter, the structure and arrangement of the first clothes treatment chamber and the second clothes treatment chamber in the clothes treatment apparatus according to the embodiment will be described with reference to FIGS. 4 to 6.

The interior of the case 10 may be divided into the first clothes treatment chamber 20 and the machine chamber 49 by the division plate 24. In the clothes treatment apparatus according to the embodiment, the clothes treatment chambers 20 and 30 are provided above the division plate 24, and the machine chamber 49 is provided below the division plate 24.

The interior of the clothes treatment chamber according to the embodiment is partitioned into the first clothes treatment chamber 20 and the second clothes treatment chamber 30 by a partition plate 32.

The first clothes treatment chamber 20 according to the embodiment is configured to permit clothes to be hung therein and to remove wrinkles from the clothes or deodorize the clothes through steam or air circulation.

The second clothes treatment chamber 30 is provided at one side of the first clothes treatment chamber 20. The second clothes treatment chamber 30 is formed in one inner side surface 14 of the case 10. That is, the case 10 is provided at one 14 of both inner side surfaces thereof with a space for defining the second clothes treatment chamber 30. The one inner side surface 14 of the case 10, in which the second clothes treatment chamber 30 is formed, may be a surface that faces the surface of the case 10 at which the hinge unit 68 for connecting the door 64 and the case 10 is installed. The second clothes treatment chamber 30 may be open in the forward direction and toward the first clothes treatment chamber 20, and may be shielded from the outside by the partition plate 32. The partition plate 32 functions as a door for opening and closing the internal space in the second clothes treatment chamber 30.

The second clothes treatment chamber 30 is provided to remove wrinkles from clothes by applying pressure to the clothes placed therein. Clothes are placed between an inner surface 31 of the second clothes treatment chamber 30 and an inner surface 33 of the partition plate 32.

The second clothes treatment chamber 30 is provided therein with a clothes-fixing member 34, to which clothes are fixed so as to be hung downwards, a base plate 16 configured to support the clothes placed in the second clothes treatment chamber 30, and a press plate 36 configured to be brought into close contact with the base plate 16 to press the clothes placed therebetween.

The base plate 16 is installed at the inner surface 31 of the second clothes treatment chamber 30. The base plate 16 according to the embodiment may be formed in the shape of a plate that exerts elastic force toward the inner surface 31 of the second clothes treatment chamber 30.

The base plate 16 is elongated in an upward-and-downward direction. The base plate 16 is provided at upper and lower portions thereof with fastening members, through which the base plate 16 is coupled to the inner surface of the second clothes treatment chamber 30. The base plate 16 includes a fixed base plate 18, which is fixed to the second clothes treatment chamber 30, and elastic base plates 19*a* and 19*b* extending from the fixed base plate 18, the elastic base plates 19*a* and 19*b* being configured to be spaced further apart from the inner surface 31 of the second clothes treatment chamber 30 than the fixed base plate 18 so as to apply elastic force to clothes.

The fixed base plate 18 is elongated in the upward-and-downward direction, and is provided at upper and lower portions thereof with fastening members, through which the fixed base plate 18 is coupled to the inner surface of the second clothes treatment chamber 30.

The elastic base plates 19*a* and 19*b* may include a first elastic base plate 19*a* and a second elastic base plate 19*b*, which extend from the fixed base plate 18 in a forward direction and in a backward direction, respectively.

The first elastic base plate 19*a* and the second elastic base plate 19*b* may be elastically deformed toward the inner surface 31 of the second clothes treatment chamber 30 due to the elastic properties of the material thereof.

Therefore, when the base plate 16 is pressed by the press plate 36, the elastic base plates 19*a* and 19*b* of the base plate 16 may move away from each other toward the inner surface 31 of the second clothes treatment chamber 30, and may be brought into uniform contact with the press plate 36.

The clothes-fixing member 34 and the press plate 36 are installed on the inner surface 33 of the partition plate 32. The clothes-fixing member 34 is disposed above the press plate 36. The clothes-fixing member 34 may be disposed at the upper portion of the partition plate 32, and may be formed in the shape of tongs for fixing clothes. Alternatively, the clothes-fixing member 34 may be disposed at the upper portion of the partition plate 32 and may be formed in the shape of a peg, on which a clothes hanger (not shown) for fixing clothes is hung.

The press plate 36 is disposed on the inner surface 33 of the partition plate 32. In the state in which the partition plate 32 closes the second clothes treatment chamber 30, the press plate 36 faces the base plate 16. When the partition plate 32 closes the second clothes treatment chamber 30, the press plate 36 is brought into close contact with the base plate 16, thereby pressing clothes located between the base plate 16 and the press plate 36.

The press plate 36 includes an opening portion 40, through which steam is supplied to clothes. The opening portion 40 is formed in the central portion of the press plate 36. Alternatively, the opening portion 40 may be formed in regions other than the central portion of the press plate 36.

The press plate 36 according to the embodiment may be formed so as to be spaced apart from the inner surface of the partition plate 32. Thus, air may flow through the space between the press plate 36 and the partition plate 32.

The partition plate 32 according to the embodiment may open and close the second clothes treatment chamber 30. The second clothes treatment chamber 30 is separated from the first clothes treatment chamber 20 by the partition plate 32 according to the embodiment. The partition plate 32 according to the embodiment is provided with the clothes-fixing member 34 for fixing clothes placed in the second clothes treatment chamber 30. In addition, the partition plate 32 is provided with the press plate 36, which is disposed below the clothes-fixing member 34 and presses clothes to smooth wrinkles from the clothes.

The partition plate 32 according to the embodiment may further include a separation portion 38, by which the partition plate 32 is spaced apart from the inner surface 31 of the second clothes treatment chamber 30 and which opens and closes the front of the second clothes treatment chamber 30.

The partition plate 32 according to the embodiment may include a moving member 42, which moves the partition plate 32 to a position for partitioning the first clothes treatment chamber 20 and the second clothes treatment chamber 30 or to the front of the case or which rotates the partition plate 32.

In the embodiment, two moving members 42 are provided at the upper portion and the lower portion of the partition plate 32 so as to protrude therefrom. Specifically, the moving members 42 are located at the upper end and the lower end of the rear side of the inner surface 33 of the partition plate 32.

The moving member 42 may include a protruding portion 44, which protrudes upwards or downwards from the partition plate 32 so as to be movable or rotatable along a moving member guide portion 70, and a connection portion 46, which connects the protruding portion 44 to the partition plate 32. The connection portion 46 is located at each of the upper end and the lower end of the rear side of the inner surface 33 of the partition plate 32. The connection portion 46, which serves to connect the protruding portion 44 to the partition plate 32, has a semi-cylindrical shape that protrudes from the inner surface 33 of the partition plate 32. However, the connection portion 46 may have any one of various other shapes, so long as it can perform the same function.

The protruding portion 44 has a shape that is capable of rotating or moving along the moving member guide portion 70 formed in each of the upper surface and the lower surface of the second clothes treatment chamber 30. The protruding portion 44 is rotatable or movable linearly along the moving member guide portion 70 at a specific position. The protruding portion 44 according to the embodiment has a rectangular column shape having a rectangular-shaped bottom surface. The protruding portion 44 protrudes in the upward or downward direction of the connection portion 46 and/or the partition plate 32.

When viewed from above, the protruding portion 44 forms an inclination angle θ with the partition plate 32. The inclination angle θ formed between the partition plate 32 and the protruding portion 44 is set to the maximum angle to which the partition plate 32 is opened from the one inner side surface 14 of the case 10. The inclination angle θ formed between the partition plate 32 and the protruding portion 44 may range from approximately 10° to approximately 50°.

The partition plate 32 may include communication holes 48 to cause the first clothes treatment chamber 20 and the second clothes treatment chamber 30 to communicate with each other. The communication holes 48 may be provided with orifices, through which air or steam flowing in the first clothes treatment chamber 20 is introduced into the second clothes treatment chamber 30. That is, steam or air flowing in the first clothes treatment chamber 20 may flow into the second clothes treatment chamber 30 through the communication holes 48.

The second clothes treatment chamber 30 is provided at each of the upper surface and the lower surface thereof with a moving member guide portion 70, along which the moving member 42 of the partition plate 32 rotates or moves. The moving member guide portion 70 includes a first rotation guide 72, which guides the partition plate 32 to rotate inside the case 10, a second rotation guide 76, which guides the partition plate 32 to rotate at the open front of the case 10, and a linear movement guide 82, which linearly connects the first rotation guide 72 and the second rotation guide 76.

The first rotation guide 72 is a circular-shaped hole, in which the moving member 42 rotates. In the state in which the partition plate 32 closes the second clothes treatment chamber 30, the protruding portion 44 of the moving member 42 is located in the first rotation guide 72. The partition plate 32 is rotated by the rotation of the protruding portion 44 in the first rotation guide 72. Through the rotation of the protruding portion 44 in the first rotation guide 72, clothes placed in the second clothes treatment chamber 30 may be pressed or released from the pressing.

The first rotation guide 72 is provided with a first stopper 74 for limiting the rotational range of the moving member 42. The first stopper 74 is formed to permit the moving member 42 to rotate to an extent such that the protruding portion 44 is parallel to the inner surface 31 of the second clothes treatment chamber 30. The first stopper 74 permits the moving member 42 to rotate to an extent such that the inclination angle formed between the partition plate 32 and the inner surface 31 of the second clothes treatment chamber 30 becomes equal to the inclination angle formed between the partition plate 32 and the protruding portion 44. The first stopper 74 permits the moving member 42 to rotate to an extent such that the protruding portion 44 becomes movable along the linear movement guide 82. The first stopper 74 is provided at an end portion of the linear movement guide 82. The first stopper 74 is formed parallel to the linear movement guide 82.

The linear movement guide 82 connects the first rotation guide 72 and the second rotation guide 76. The width D1 of the linear movement guide 82 may be equal to or greater than the thickness D2 of the protruding portion 44 so that the protruding portion 44 is capable of moving along the linear movement guide 82. The linear movement guide 82 is elongated toward the open front of the case 10.

The second rotation guide 76 is a circular-shaped hole, in which the moving member 42 rotates. In the state in which the partition plate 32 protrudes forwards, the protruding portion 44 of the moving member 42 is located in the second rotation guide 76. The partition plate 32 is rotated by the rotation of the protruding portion 44 in the second rotation guide 76. Through the rotation of the protruding portion 44 in the second rotation guide 76, the inner surface 31 of the partition plate 32 may be located so as to face the open front of the case 10.

The second rotation guide 76 is provided with a second stopper 78, which limits the rotation of the moving member 42 in one direction, and a third stopper 80, which limits the rotation of the moving member 42 in the opposite direction.

The second stopper 78 limits the rotation of the moving member 42 so that the inner surface 33 of the partition plate 32 is located so as to face the open front of the case 10. The second stopper 78 limits the rotation of the moving member 42 so that the partition plate 32 is located perpendicular to the inner surface 31 of the second clothes treatment chamber 30.

The third stopper 80 permits the moving member 42 to rotate to an extent such that the inclination angle formed between the partition plate 32 and the inner surface 31 of the second clothes treatment chamber 30 becomes equal to the inclination angle formed between the partition plate 32 and the protruding portion 44. The third stopper 80 permits the moving member 42 to rotate to an extent such that the protruding portion 44 becomes movable along the linear movement guide 82. The third stopper 80 is formed parallel to the linear movement guide 82.

The protruding portion 44 is rotated in the second rotation guide 76 so that the inner surface 33 of the partition plate 32 is oriented toward the open front of the case 10 or so that the partition plate 32 is movable along the linear movement guide 82.

The first stopper 74 and the third stopper 80 may be formed to be symmetrical to each other with respect to the center of the linear movement guide 82.

<Movement of Partition Plate>

FIGS. 7*a* to 7*d* are views illustrating the rotation and movement of the partition plate according to the embodiment. FIGS. 8*a* to 8*d* are views illustrating the rotation and movement of a moving member when the partition plate rotates and moves as shown in FIGS. 7*a* to 7*d*.

Figure 7A:
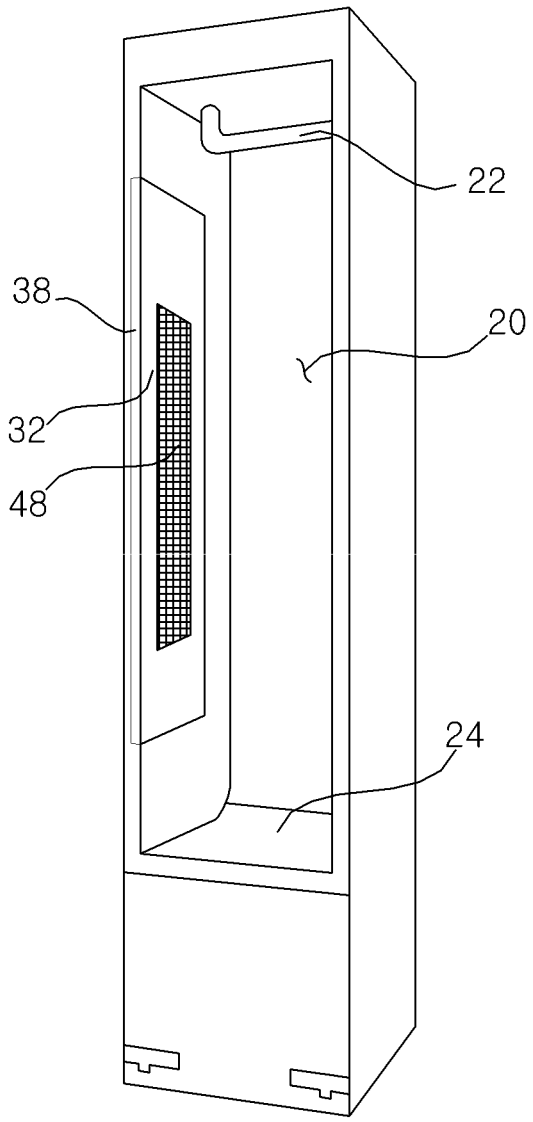
FIGS. 7*a* to 7*d* are views illustrating the rotation and movement of the partition plate according to the embodiment.
Figure 7B:
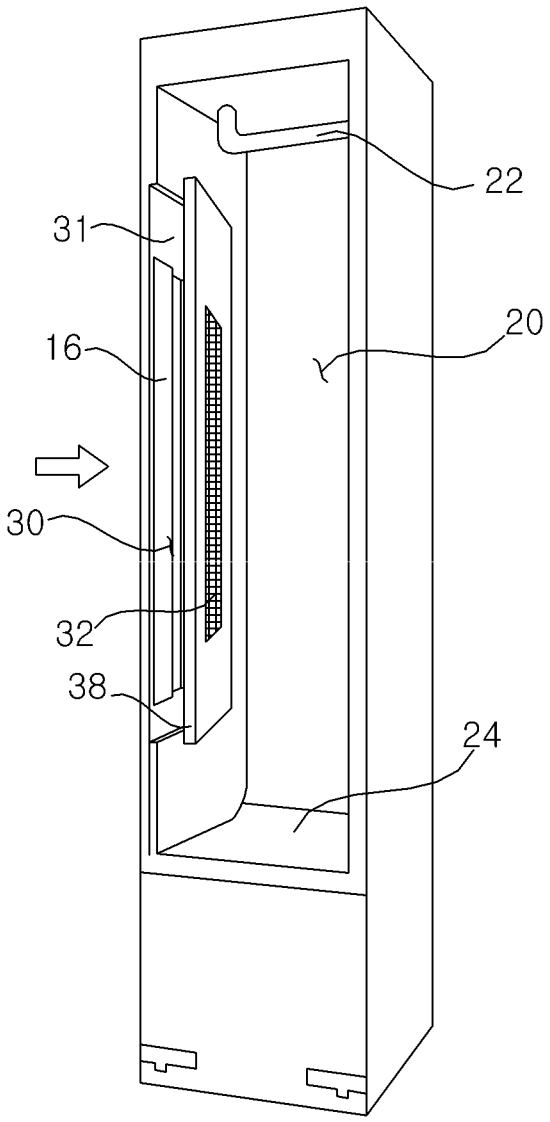
Figure 7C:
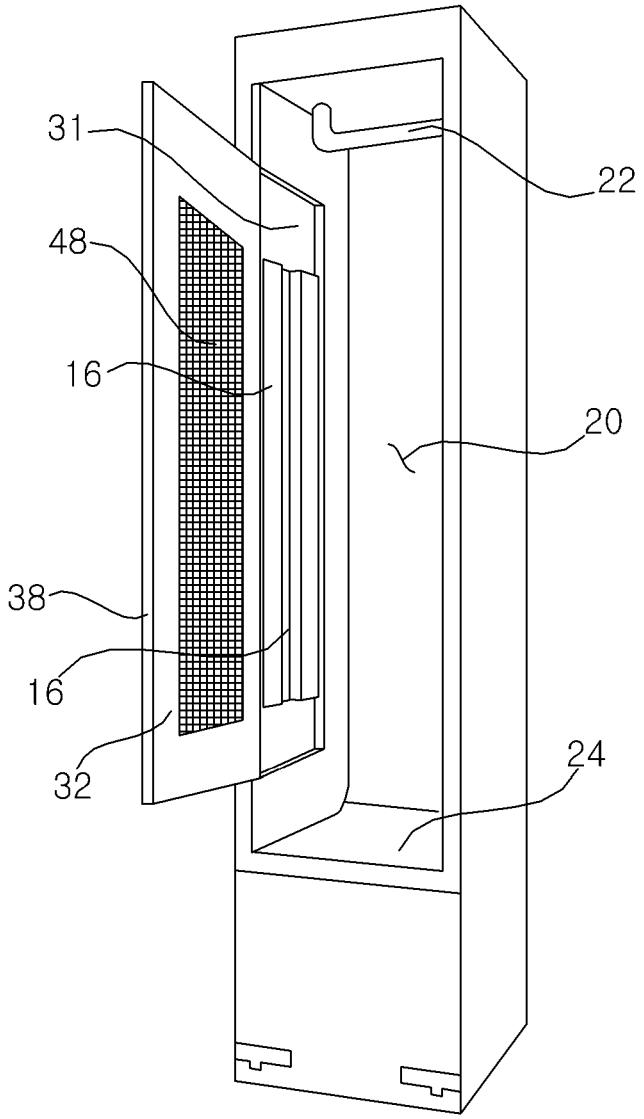
Figure 7D:
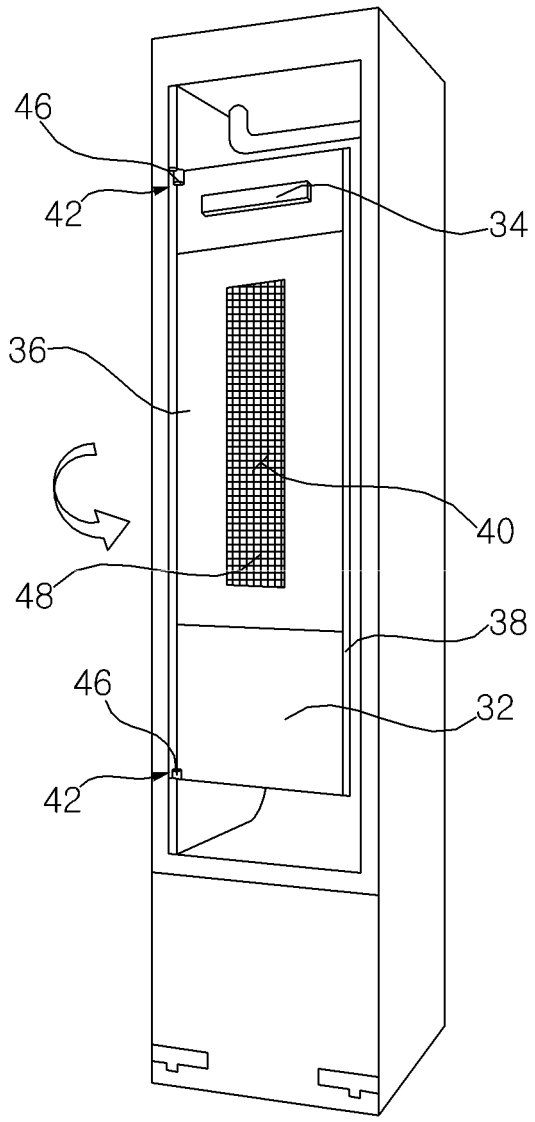

Referring to FIGS. 7*a* to 7*d*, the partition plate 32 may rotate or move along the moving member guide portion 70. Hereinafter, for convenience of explanation, the position at which the partition plate is located in FIG. 7*a* is referred to as a first position, the position at which the partition plate is located in FIG. 7*b* is referred to as a second position, the position at which the partition plate is located in FIG. 7*c* is referred to as a third position, and the position at which the partition plate is located in FIG. 7*d* is referred to as a fourth position.

As shown in FIG. 7*a*, when the partition plate 32 is located at the first position, the second clothes treatment chamber 30 may be maintained in a closed state. When the partition plate 32 is located at the first position, the inner surface 33 of the partition plate 32 faces the inner surface 31 of the second clothes treatment chamber 30. As shown in FIG. 7*a*, when the partition plate 32 is located at the first position, clothes placed in the second clothes treatment chamber 30 are pressed by the base plate 16 and the press plate 36.

Figure 8A:
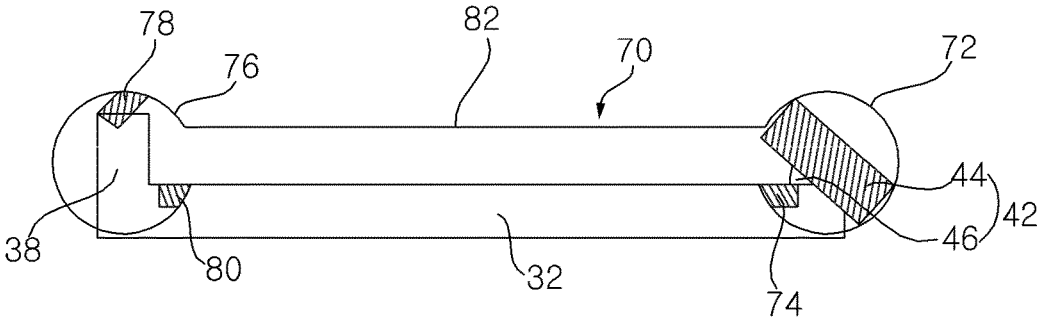
FIGS. 8*a* to 8*d* are views illustrating the rotation and movement of a moving member when the partition plate rotates and moves as shown in FIGS. 7*a* to 7*d*.

Referring to FIG. 8*a*, when the partition plate 32 is located at the first position, the protruding portion 44 of the moving member 42 is located in the first rotation guide 72 of the moving member guide portion 70. Referring to FIG. 8*a*, when the partition plate 32 is located at the first position, the protruding portion 44 of the moving member 42 is capable of rotating in the counterclockwise direction. Referring to FIG. 8*a*, when the partition plate 32 is located at the first position, the separation portion 38 of the partition plate 32 is brought into contact with the inner surface 31 of the second clothes treatment chamber 30 and is thus incapable of rotating in the clockwise direction. Referring to FIG. 8*a*, when the partition plate 32 is located at the first position, the protruding portion 44 of the moving member 42 is not parallel to the linear movement guide 82 and is thus incapable of moving along the linear movement guide 82.

When the moving member 42 rotates from the first position of the partition plate in the counterclockwise direction, the moving member 42 may rotate to the position of the first stopper 74. When the moving member 42 rotates from the first position of the partition plate in the counterclockwise direction to the position of the first stopper 74, the partition plate 32 is located at the second position, as shown in FIG. 7*b*.

As shown in FIG. 7*b*, when the partition plate 32 is located at the second position, the front of the second clothes treatment chamber 30 may be maintained in the partially opened state. As shown in FIG. 7*b*, when the partition plate 32 is located at the second position, the partition plate 32 is inclined relative to the inner surface 31 of the second clothes treatment chamber 30.

Figure 8B:
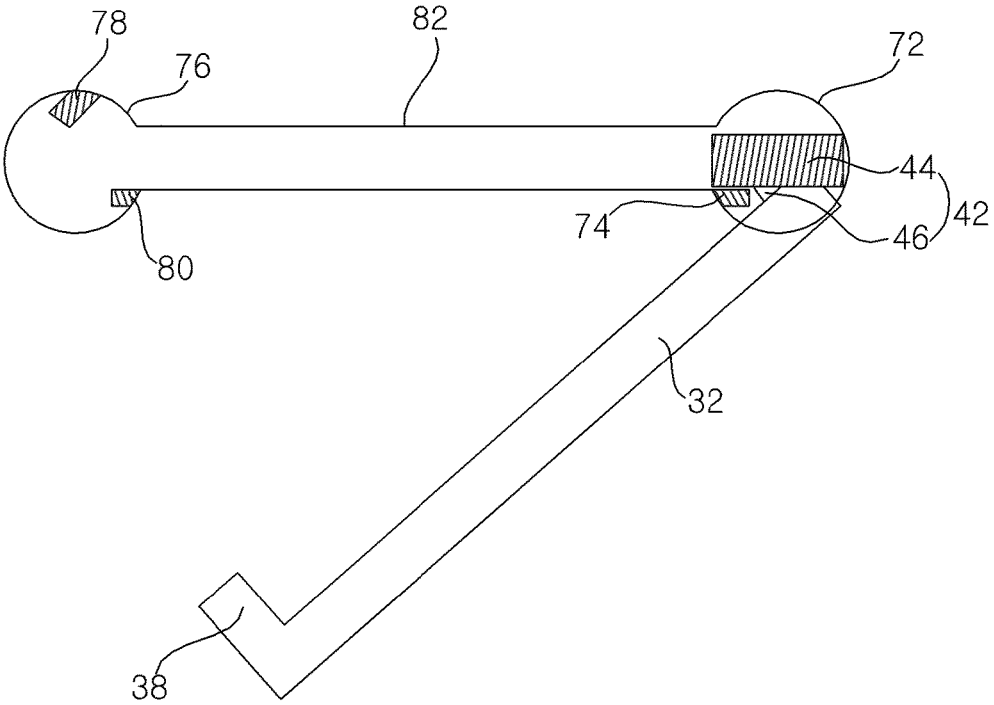

Referring to FIG. 8*b*, when the partition plate 32 is located at the second position, the protruding portion 44 of the moving member 42 is located in the first rotation guide 72 of the moving member guide portion 70. Referring to FIG. 8*b*, when the partition plate 32 is located at the second position, the protruding portion 44 of the moving member 42 is capable of rotating in the clockwise direction. Referring to FIG. 8*b*, when the partition plate 32 is located at the second position, the protruding portion 44 of the moving member 42 is brought into contact with the first stopper 74 and is thus incapable of rotating in the counterclockwise direction. Referring to FIG. 8*b*, when the partition plate 32 is located at the second position, the protruding portion 44 of the moving member 42 becomes parallel to the linear movement guide 82 and is thus capable of moving along the linear movement guide 82.

When the moving member 42 moves forwards from the second position of the partition plate along the linear movement guide 82, the moving member 42 may reach the second rotation guide 76. When the moving member 42 moves from the second position of the partition plate along the linear movement guide 82, the partition plate 32 may be located at the third position, as shown in FIG. 7*c*. When the partition plate 32 moves along the linear movement guide 82, the partition plate 32 is spaced apart from the inner surface 31 of the second clothes treatment chamber 30 at a constant inclination angle. That is, while the partition plate 32 moves from the second position to the third position, the inclination angle formed between the partition plate 32 and the inner surface 31 of the second clothes treatment chamber 30 is maintained constant. Therefore, even when the partition plate 32 moves from the second position to the third position, clothes located between the base plate 16 and the press plate 36 are prevented from being damaged.

As shown in FIG. 7*c*, when the partition plate 32 is located at the third position, the second clothes treatment chamber 30 may be maintained in the state of being open toward the first clothes treatment chamber 20. As shown in FIG. 7*c*, when the partition plate 32 is located at the third position, the partition plate 32 is inclined relative to the inner surface 31 of the second clothes treatment chamber 30. As shown in FIG. 7*c*, when the partition plate 32 is located at the third position, the partition plate 32 protrudes ahead of the case 10.

Figure 8C:
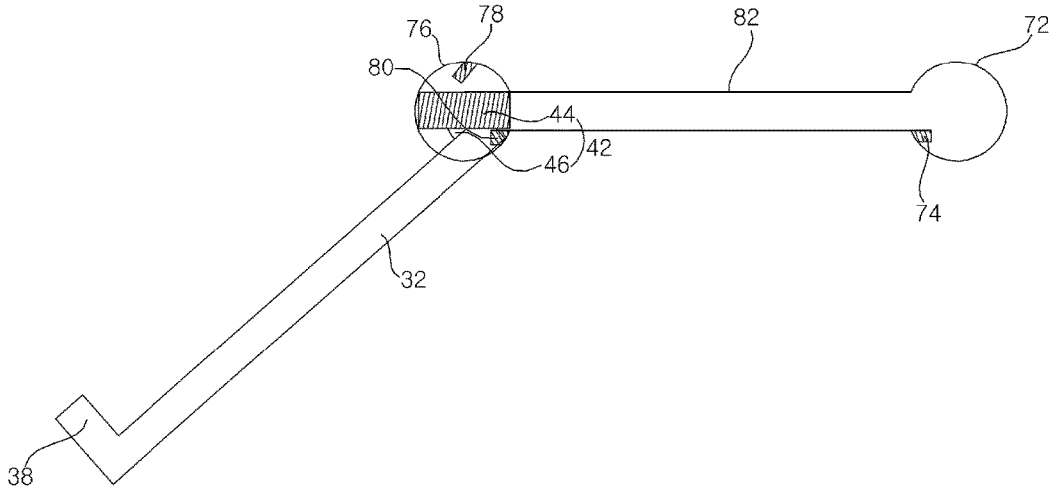

Referring to FIG. 8*c*, when the partition plate 32 is located at the third position, the protruding portion 44 of the moving member 42 is located in the second rotation guide 76 of the moving member guide portion 70. Referring to FIG. 8*c*, when the partition plate 32 is located at the third position, the protruding portion 44 of the moving member 42 is capable of rotating in the counterclockwise direction. Referring to FIG. 8*c*, when the partition plate 32 is located at the third position, the protruding portion 44 of the moving member 42 is brought into contact with the third stopper 80 and is thus incapable of rotating in the clockwise direction. Referring to FIG. 8*c*, when the partition plate 32 is located at the third position, the protruding portion 44 of the moving member 42 becomes parallel to the linear movement guide 82 and is thus capable of moving along the linear movement guide 82.

When the moving member 42 rotates from the third position of the partition plate in the second rotation guide 76 in the counterclockwise direction, the moving member 42 may rotate until the moving member 42 is brought into contact with the second stopper 78. When the moving member 42 rotates from the third position of the partition plate in the second rotation guide 76 in the counterclockwise direction, the partition plate 32 may be located at the fourth position, as shown in FIG. 7*d*.

As shown in FIG. 7*d*, when the partition plate 32 is located at the fourth position, the second clothes treatment chamber 30 may be maintained in the state of being open toward the first clothes treatment chamber 20. As shown in FIG. 7*d*, when the partition plate 32 is located at the fourth position, the partition plate 32 is perpendicular to the inner surface 31 of the second clothes treatment chamber 30. As shown in FIG. 7*d*, when the partition plate 32 is located at the fourth position, the inner surface 33 of the partition plate 32 faces the front of the case 10.

Figure 8D:
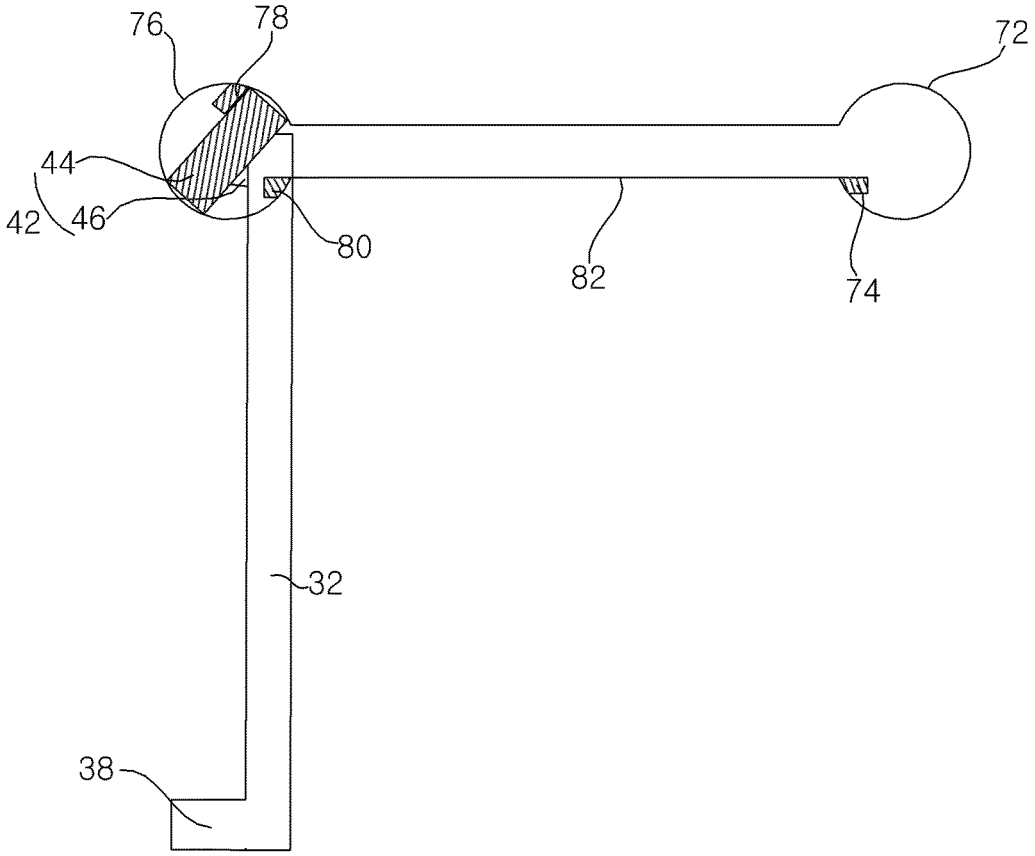

Referring to FIG. 8*d*, when the partition plate 32 is located at the fourth position, the protruding portion 44 of the moving member 42 is located in the second rotation guide 76 of the moving member guide portion 70. Referring to FIG. 8*d*, when the partition plate 32 is located at the fourth position, the protruding portion 44 of the moving member 42 is capable of rotating in the clockwise direction. Referring to FIG. 8*d*, when the partition plate 32 is located at the fourth position, the protruding portion 44 of the moving member 42 is brought into contact with the second stopper 78 and is thus incapable of rotating in the counterclockwise direction. Referring to FIG. 8*d*, when the partition plate 32 is located at the fourth position, the protruding portion 44 of the moving member 42 is not parallel to the linear movement guide 82 and is thus incapable of moving along the linear movement guide 82.

As is apparent from the above description, a clothes treatment apparatus according to the present invention has the following effects.

First, the internal space of a case is partitioned into a clothes treatment chamber (first clothes treatment chamber) for treating clothes using steam or air circulation and a clothes treatment chamber (second clothes treatment chamber) for treating clothes by applying pressure to the same.

Second, even when a partition plate for opening and closing the second clothes treatment chamber moves, damage to clothes placed in the first clothes treatment chamber or the second clothes treatment chamber is minimized.

Third, when the partition plate is opened, it moves forwards such that the inner surface thereof faces the front of the case. Therefore, it becomes easy to hang clothes in the second clothes treatment chamber.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A clothes treatment apparatus comprising:

a case that defines an external appearance of the clothes treatment apparatus, the case having an opening at a front surface thereof;

a door coupled to the case and configured to open and close at least a portion of the opening;

a first clothes treatment chamber defined in the case and configured to treat first clothes based on circulation of steam or air;

a second clothes treatment chamber defined at a side of the first clothes treatment chamber and configured to reduce wrinkles from second clothes based on pressure applied to the second clothes;

a machine chamber configured to (i) supply steam to the first clothes treatment chamber or the second clothes treatment chamber or (ii) circulate air through the first clothes treatment chamber or the second clothes treatment chamber;

a partition plate that is disposed in the case and that partitions the second clothes treatment chamber from the first clothes treatment chamber, the partition plate being configured to open and close the second clothes treatment chamber; and a clothes-fixing member that is disposed at an inner surface of the partition plate, that is configured to hang the second clothes in the second clothes treatment chamber, and that is configured to face the second clothes treatment chamber based on the partition plate closing the second clothes treatment chamber.

2. The clothes treatment apparatus according to claim 1, wherein the second clothes treatment chamber is recessed from an inner surface of the case.

3. The clothes treatment apparatus according to claim 1, wherein the first clothes treatment chamber and the second clothes treatment chamber are separate spaces defined in the case based on the partition plate closing the second clothes treatment chamber.

4. The clothes treatment apparatus according to claim 3, wherein the clothes-fixing member is disposed at an upper portion of the inner surface of the partition plate.

5. The clothes treatment apparatus according to claim 3, wherein the second clothes treatment chamber is configured to accommodate the second clothes in an orientation facing an inner side surface of the case.

6. The clothes treatment apparatus according to claim 3, wherein the second clothes treatment chamber faces a rotational axis of the door.

7. The clothes treatment apparatus according to claim 6, wherein the door is coupled to a first side of the case, and wherein the second clothes treatment chamber is defined at an inner side surface of a second side of the case, the second side facing the first side and being spaced apart from the first side in a width direction of the case.

8. The clothes treatment apparatus according to claim 3, wherein the partition plate comprises:

a separation portion that protrudes from the inner surface of the partition plate and that is configured to define a space between the inner surface of the partition plate and an inner side surface of the case based on the partition plate closing the second clothes treatment chamber.

9. The clothes treatment apparatus according to claim 8, wherein the separation portion protrudes from a front side of the inner surface of the partition plate.

10. The clothes treatment apparatus according to claim 9, wherein at least a part of the separation portion defines a part of the front surface of the case.

11. The clothes treatment apparatus according to claim 3, further comprising:

a base plate that is disposed in the second clothes treatment chamber, that is configured to face the partition plate based on the partition plate closing the second clothes treatment chamber, and that is configured to support the second clothes in the second clothes treatment chamber; and a press plate disposed at the inner surface of the partition plate and positioned vertically below the clothes-fixing member, the press plate being configured to press the second clothes toward the base plate.

12. The clothes treatment apparatus according to claim 11, wherein the base plate comprises:

a fixed base plate fixed in the second clothes treatment chamber; and an elastic base plate that extends from the fixed base plate and that protrudes toward the second clothes treatment chamber relative to the fixed base plate.

13. The clothes treatment apparatus according to claim 11, wherein the clothes-fixing member is configured to be disposed vertically above the base plate based on the partition plate closing the second clothes treatment chamber.

14. The clothes treatment apparatus according to claim 11, wherein the press plate includes an opening portion that is configured to communicate air or steam between the first clothes treatment chamber and the second clothes treatment chamber based on the partition plate closing the second clothes treatment chamber.

15. The clothes treatment apparatus according to claim 11, further comprising a moving member coupled to the partition plate, the moving member being configured to rotate the partition plate toward the base plate or away from the base plate.

16. The clothes treatment apparatus according to claim 15, further comprising a stopper configured to limit rotation of the partition plate away from the base plate.

17. The clothes treatment apparatus according to claim 15, wherein the moving member is disposed at a rear side of the inner surface of the partition plate.

18. The clothes treatment apparatus according to claim 15, wherein the moving member is disposed at each of an upper portion of the partition plate and a lower portion of the partition plate, the moving member being configured to rotate or linearly move the partition plate relative to the second clothes treatment chamber.

19. The clothes treatment apparatus according to claim 18, wherein the partition plate is configured to linearly move toward the front surface of the case along an inner side surface of the case.

20. The clothes treatment apparatus according to claim 19, wherein the partition plate is configured to, based on linearly moving toward the front surface of the case, rotate toward the first clothes treatment chamber such that the clothes-fixing member is exposed to an outside of the first clothes treatment chamber.

* * * * *